US007926966B2

(12) United States Patent
Winters

(10) Patent No.: US 7,926,966 B2
(45) Date of Patent: Apr. 19, 2011

(54) ILLUMINABLE DEVICE FOR ACCESSORIZING A VESSEL

(75) Inventor: Gregory E. Winters, Ridgecrest, CA (US)

(73) Assignee: WE Glowsource, Inc., Ridgecrest, CA (US)

( * ) Notice: Subject to any disclaimer, the term of this patent is extended or adjusted under 35 U.S.C. 154(b) by 130 days.

(21) Appl. No.: 12/271,757

(22) Filed: Nov. 14, 2008

(65) Prior Publication Data

US 2010/0124048 A1 May 20, 2010

(51) Int. Cl.
*F21V 33/00* (2006.01)

(52) U.S. Cl. ..... 362/101; 362/240; 362/246

(58) Field of Classification Search ..... 362/96, 362/101, 227, 235, 236, 238, 240, 242, 244, 362/246, 249.01, 249.02, 249.05, 249.08, 362/249.16, 300, 310, 311.14, 320, 326, 362/351, 800, 806

See application file for complete search history.

(56) References Cited

U.S. PATENT DOCUMENTS

| | | | | |
|---|---|---|---|---|
| 4,344,113 | A * | 8/1982 | Ditto et al. | 362/101 |
| 5,575,553 | A * | 11/1996 | Tipton | 362/101 |
| 6,065,848 | A * | 5/2000 | Tucker et al. | 362/101 |
| 6,164,793 | A * | 12/2000 | Wu | 362/101 |
| 6,371,624 | B1 * | 4/2002 | Dorney | 362/34 |
| 6,793,362 | B2 * | 9/2004 | Tai | 362/101 |
| 6,793,363 | B2 * | 9/2004 | Jensen | 362/101 |
| 6,796,670 | B2 | 9/2004 | Winters et al. | |
| D523,293 | S | 6/2006 | Disbrow et al. | |
| 7,690,533 | B2 * | 4/2010 | Stilley | 222/113 |
| 2003/0223222 | A1 * | 12/2003 | Yu | 362/96 |
| 2004/0080930 | A1 * | 4/2004 | Winters et al. | 362/101 |
| 2008/0130266 | A1 * | 6/2008 | DeWitt et al. | 362/96 |

OTHER PUBLICATIONS http://www.asi44888.com/product.asp?ID=11106&CatID=0
Brighter Promotions Line—Light-Up Sticky Bottoms.

* cited by examiner

*Primary Examiner* — Hargobind S Sawhney
(74) *Attorney, Agent, or Firm* — Harness, Dickey & Pierce, P.L.C.

(57) ABSTRACT

An illuminable accessory device for use with a vessel. A pliable, generally cylindrical sidewall can slidingly receive and hold a bottom portion of a vessel. The received vessel bottom portion is slidingly removable from the sidewall. An electrically powered light source surrounded by the sidewall lies beneath the received vessel bottom portion. The light source is enclosed in a light disk through at least a portion of which light from the light source is transmissible. The light disk supports the received vessel. This accessory device can produce various lighting effects, e.g., in a liquid held in a bottle, cup or other container.

21 Claims, 9 Drawing Sheets

ILLUMINABLE DEVICE FOR ACCESSORIZING A VESSEL

FIELD

The present disclosure relates to illuminable articles and more particularly (but not exclusively) to an illuminable accessory device that can be used with bottles, cups and/or other vessels.

BACKGROUND

This section provides background information related to the present disclosure which is not necessarily prior art.

Novelty products are frequently used for entertainment purposes and also may serve as media for advertising. Such products include various vessels for use in eating and drinking, e.g., souvenir glasses, bottles and cups commemorating a special event, destination, or holiday. Coasters and other food- and/or beverage-related accessories are frequently distributed as promotional items bearing slogans, advertisements, and/or logos. Many novelty products are functional yet imaginative and eye-catching.

SUMMARY

This section provides a general summary of the disclosure, and is not a comprehensive disclosure of its full scope or all of its features.

The present disclosure, in one configuration, is directed to an illuminable accessory device for use with a vessel. A pliable, generally cylindrical sidewall is configured to slidingly receive and hold a bottom portion of a vessel. The received vessel bottom portion is slidingly removable from the sidewall. An electrically powered light source is surrounded by the sidewall and configured to lie beneath the received vessel bottom portion. The light source is enclosed in a light disk through at least a portion of which light from the light source is transmissible. The light disk is configured to support the received vessel.

In another configuration, the disclosure is directed to a illuminable accessory device for use with a vessel. The device includes a pliable, generally cylindrical sidewall. A bottom ledge extends radially inwardly from a bottom end of the sidewall. A light disk is supported on the ledge inside the sidewall. The disk includes an electrically powered light source capable of emitting light through at least a portion of the disk. The sidewall is configured to slidingly receive and adhere to a bottom portion of a vessel. The disk is configured to lie beneath the received vessel bottom portion. The sidewall is further configured to allow the received vessel bottom portion to be slidingly removed from the device.

In yet another configuration, the disclosure is directed to a illuminable accessory device for use with a vessel. A pliable, generally cylindrical sidewall is configured to slidingly receive and hold a bottom portion of a vessel. The received vessel bottom portion is slidingly removable from the sidewall. An electrically powered light source is surrounded by the sidewall and configured to lie beneath the received vessel bottom portion. The light source is enclosed in a liquid-resistant and at least partially translucent light disk configured to support the received vessel. The disk is removable from the accessory device through a top of the sidewall.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In various implementations the disclosure is directed to an illuminable device for accessorizing a vessel such as a bottle, cup, glass or can. Such an accessory device may be at least partially translucent and/or transparent and can provide an area on which to imprint promotional logos, pictures, and/or information. When, e.g., a beverage bottle is placed in an accessory device in accordance with the disclosure, light may be transmitted from and through the device into the bottle and liquid contained in the bottle. Various lighting effects can be achieved dependent on the device and vessel configurations. It should be understood that the term "vessel" is used in the present disclosure and claims to refer to any of a wide variety of containers, including but not limited to bottles, cans, cups, glasses, mugs, flasks, jars, etc. Vessels can vary in shape, size, and coloration, and may be partially or completely transparent, translucent, opaque, or any combination of the foregoing. Vessels may be partially or completely sealed, covered and/or open when held by an illuminable device in accordance with the disclosure.

Figure 1A:
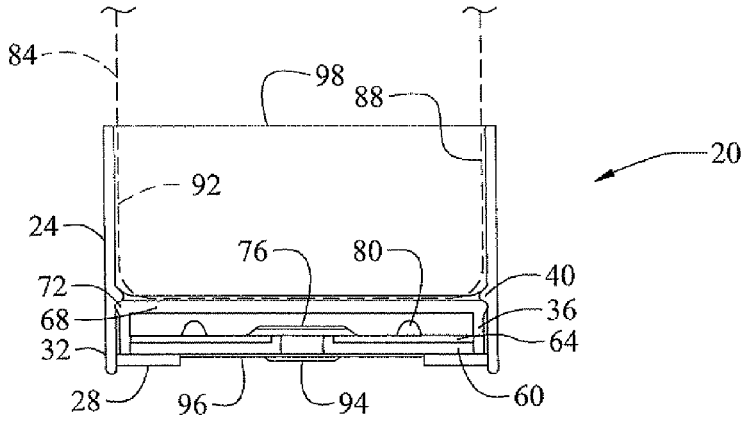
FIG. 1A is an elevational cross-sectional view of an illuminable device in accordance with one implementation of the disclosure.

An elevational cross-sectional view of one configuration of an illuminable device is indicated generally in FIG. 1A by reference number 20. The device 20 has a pliable, generally cylindrical sidewall 24. A bottom ledge 28 extends radially inwardly from a bottom end 32 of the sidewall 24. A light disk 36 is supported on the ledge 28 inside the sidewall 24. As further described below, the light disk 36 serves to contain and protect an electrically powered light source and electronics for operating the light source.

Figure 1B:
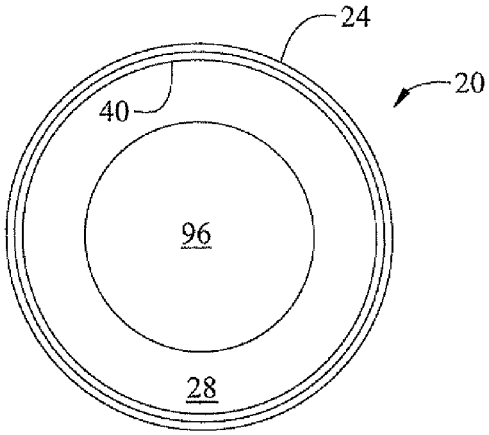
FIG. 1B is a top view of the illuminable device shown in FIG. 1A, with a light disk removed.

A retaining device 40 molded in the sidewall 24 serves to retain the light disk 36 in the sidewall 24. Although the device 40 shown in FIG. 1A is a retaining ring, in other implementations other structure(s), e.g., a plurality of beads, ridges and/or other shapes molded in a sidewall, could be provided as a retaining device to retain a light disk in the sidewall. Additionally or alternatively, grooves, dimples, and/or other indentations in a sidewall could be used as a retaining device. A top view of the device 20 with the disk 36 removed is shown in FIG. 1B.

Figure 1C:
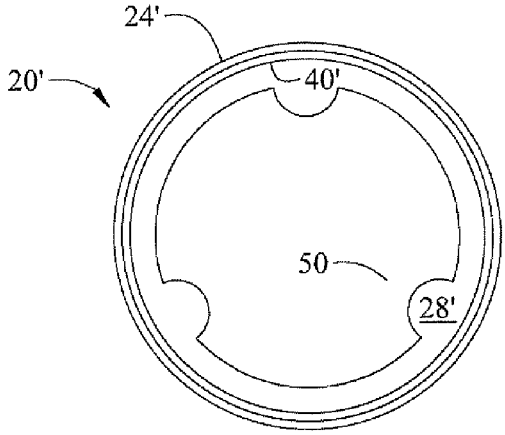
FIG. 1C is a top view of an illuminable device in accordance with one implementation of the disclosure, shown with a light disk removed.

Another configuration of an illuminable device with a light disk removed is indicated generally in FIG. 1C by reference number 20'. The device 20' includes a sidewall 24' and a retaining ring 40'. A ledge 28' of the device 20' is narrower than the ledge 28 of the device 20 and includes a plurality of protrusions 50. Using the ledge 28' can save weight compared to the device 20 and also allows more light disk surface area to be exposed beneath the device 20'.

Referring again to FIG. 1A, the light disk 36 has a water-resistant exterior and includes a base 60, a circuit board 64, and a cover 68. The cover 68 has a thin (e.g., one millimeter thick) circumferential rib 72 configured to fit beneath the retaining ring 40 of the sidewall. Instead of or in addition to the rib 72, the cover may have other protrusions molded thereon, and/or a circumferential groove and/or other indentations therein, that align relative to the retaining ring or other retaining device 40 of the sidewall 24 to aid in retaining the disk.

The circuit board 64 includes one or more batteries 76 (one being shown in FIG. 1A) and a light source, e.g., one or more light-emitting diodes (LEDs) 80 (two being shown in FIG. 1A). In many configurations, between one and six LEDs may be provided, three LEDs being typical. More than six LEDs could be provided, however, in some implementations. The LEDs 80 are capable of emitting light through one or more portions of the disk 36 and, e.g., into and/or through a vessel 84 (shown in phantom) held in the device 20. The LED(s) 80 may be oriented in parallel and/or each individually in a plurality of directions, including but not limited to being directed toward the vessel and/or angled to emit light substantially toward the sidewall 24.

The sidewall 24 includes a substantially smooth inner surface 88 relative to which the bottom portion of the vessel 84 is slidingly receivable and slidingly removable. Accordingly, when the vessel 84 is placed into the device 20, the sidewall 24 slidingly receives and adheres to a bottom portion 92 of the vessel 84. The light disk 36 lies beneath, and in many configurations supportively contacts, the bottom portion 92 of the vessel. When the vessel 84 is removed from the device 20, the sidewall 24 allows the bottom portion 92 of the vessel to be slidingly removed from the device 20.

The sidewall 24 may be fabricated of thin-wall plastic, e.g., injection-molded polyethylene or polypropylene having a thickness of, e.g., about 0.03 inches. Other dimensions and materials, however, are possible. The sidewall 24 is sufficiently thin, flexible and smooth to allow a disposable cup or other manually crushable vessel to be inserted in and removed from the device 20 without damage to the vessel. The device 20 thus can be used to hold various types of disposable cups and containers, including plastic, paper and/or foam cups. Dependent on cup thickness, opacity and construction, lighting effects produced by the device 20 tend to be more visible through a plastic cup than through paper or foam cup types.

Although the sidewall 24 is configured to receive vessel bottoms having diameters about the same as that of the sidewall, the sidewall 24 is sufficiently soft and pliable to accommodate a vessel slightly larger in diameter. For example, in configurations in which the sidewall 24 has a diameter of about 60 millimeters, it can receive a vessel having a diameter between about 2 and 3 millimeters larger than the sidewall diameter. Pressing a vessel into the accessory device 20 can produce a slight vacuum effect between the vessel bottom and the disk cover 68, thereby contributing to adherence of the accessory device 20 to the vessel bottom. When a user wishes to remove a vessel from the device 20, he/she may flex the sidewall 24 to admit air into the vacuum, thereby facilitating removal of the vessel.

In various configurations the device sidewall 24 may have a substantially constant thickness and may exhibit a profile not substantially wider than that of a vessel held in the device. Where, for example, a bottle is placed in an accessory device configuration having a sidewall about 0.03 inches thick, the accessory device does not occupy a substantially greater amount of counter space than the bottle by itself would occupy.

The LEDs 80 may be activated, for example, via a push-button switch 94 beneath the base 60 and accessible through a central opening 96 defined by the ledge 28. In some configurations, a light source may be activated via motion or liquid, for example, by twisting the disk 36 in the sidewall 24. Additionally or alternatively, a light source 80 could be activated by radiofrequency. Battery(s) 76 may be connected on top of the circuit board 64, as shown in FIG. 1A, and/or beneath the circuit board 64.

To assemble the device 20, the circuit board 64 and switch 94 are installed in the base 60. The cover 68 is then placed over and secured to the base 60. The assembled disk 36 is then placed into the sidewall 24 through the sidewall top 98 and pressed against and past the retaining ring 40 to seat and secure the disk 36 on the ledge 28. In the event that it is desired to replace the disk 36, the disk can be removed, i.e., pushed up from the bottom opening 96 through the sidewall 24, and replaced.

Figure 2A:
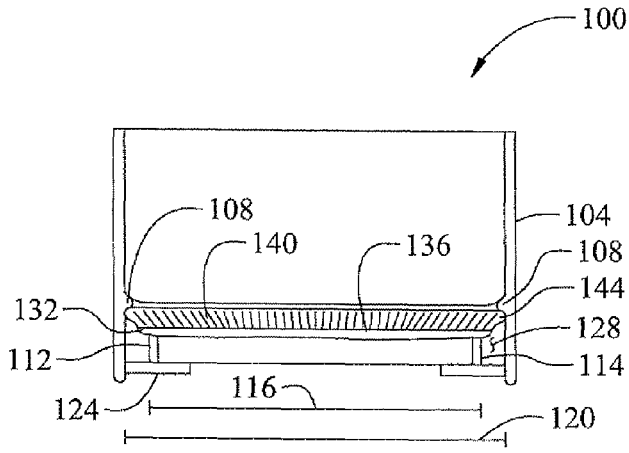
FIG. 2A is an elevational cross-sectional view of an illuminable device including a sizing ring in accordance with one implementation of the disclosure.

In some implementations a single light disk can be used in a plurality of illuminable devices of different sizes. One such disk configuration is included in an illuminable device indicated generally in FIG. 2A by reference number 100. The device 100 is shown in cross section and includes a sidewall 104 having a retaining ring 108. A light disk 112 includes a base and circuit board (not shown) and a cover 114. The disk 112 has a diameter 116 smaller than a diameter 120 of the device 100 and is supported on a ledge 124. Thus a space 128 is defined between the disk 112 and sidewall 104. The disk 112 can be water-resistant. The disk cover 114 has a thin (e.g., one millimeter thick) circumferential rib 132 extending laterally from a top edge 136 of the cover. A sizing ring 140 is configured around the disk cover 114 to center the disk 112 relative to the retaining ring 108. The sizing ring 140 is made of thin plastic and/or rubber.

Figure 2B:
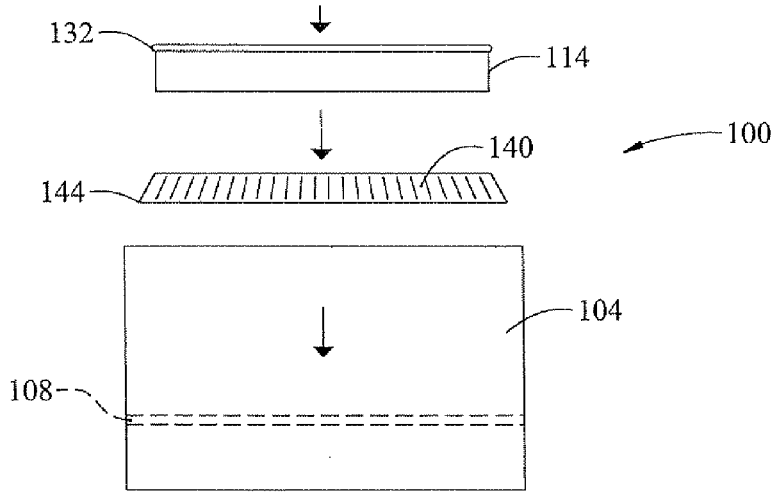
FIG. 2B is an exploded side view of the illuminable device shown in FIG. 2A.

An exploded side view of the device 100 is shown in FIG. 2B. To assemble the device 100, the disk cover 114 is inserted through the sizing ring 140, which is pressed upward against the circumferential rib 132 of the cover 114. The disk cover 114 is pressed into the sidewall 104 past the sidewall retaining ring 108. An edge 144 of the sizing ring 140 fits beneath the sidewall retaining ring 108. Sizing rings having various edge widths and shapes can be used to adapt a light disk for use in various sizes of illuminable device sidewalls. Accordingly, a light disk may be made in a single size that fits the smallest of several sizes of holding devices and that can also be adapted for inclusion in the larger devices through the use of various sizing rings.

Figure 3A:
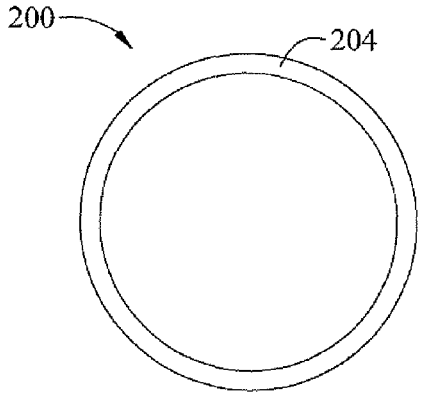
FIG. 3A is a top view of a sizing ring in accordance with one implementation of the disclosure.
Figure 3B:
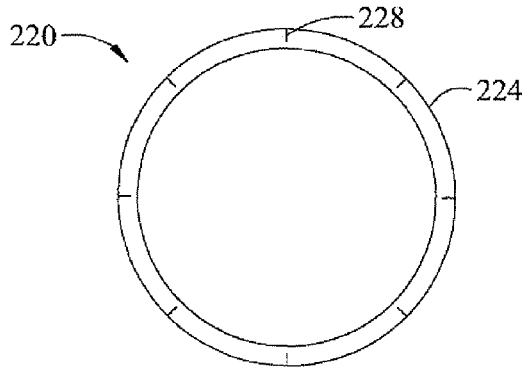
FIG. 3B is a top view of a sizing ring in accordance with one implementation of the disclosure.
Figure 3C:
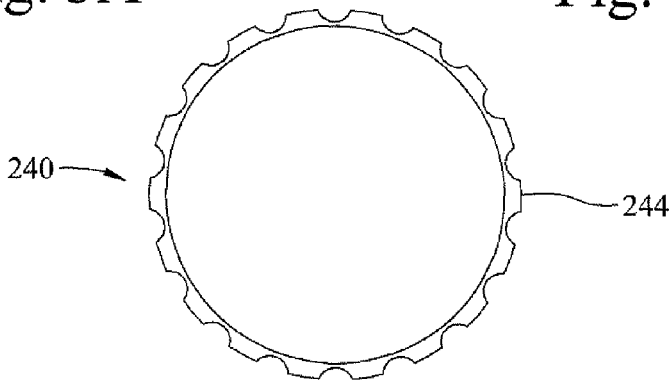
FIG. 3C is a top view of a sizing ring in accordance with one implementation of the disclosure.

Several configurations of sizing rings are shown in FIGS. 3A-3C. As shown in FIG. 3A, a sizing ring 200 may have a solid edge 204. As shown in FIG. 3B, another sizing ring configuration 220 has an edge 224 having partial slits 228. As shown in FIG. 3C, yet another sizing ring configuration 240 has a serrated edge 244. Other or additional types of sizing rings are contemplated. For example, an elastic sizing ring may be used, e.g., as further described below.

Figure 4A:
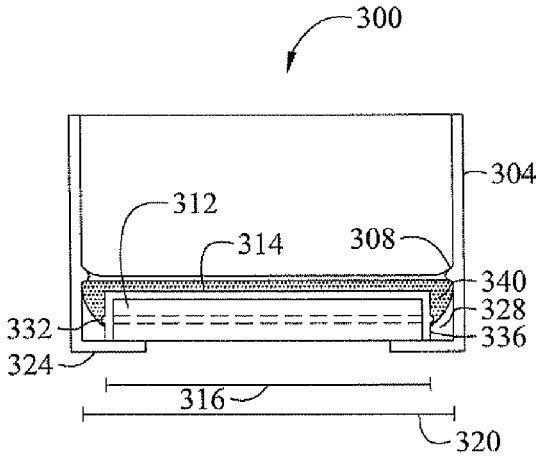
FIG. 4A is an elevational cross-sectional view of an illuminable device including a sizing ring in accordance with one implementation of the disclosure.

Another configuration of an illuminable holding device is indicated generally in FIG. 4A by reference number 300. The device 300 is shown in cross section and includes a sidewall 304 having a retaining ring 308. A light disk 312 includes a base and circuit board (not shown) and a cover 314. The disk 312 has a diameter 316 smaller than a diameter 320 of the device 300. The disk 312 is supported on a ledge 324. Thus a space 328 is defined between the disk 312 and sidewall 304. The disk 312 may be water-resistant. The disk cover 314 has a thin (e.g., one millimeter thick) circumferential rib 332. The rib 332 extends laterally around a lateral wall 336 of the cover 314. A sizing ring 340 is configured around the disk cover 314 to center the disk 312 relative to the retaining ring 308. The sizing ring 340 is made of thin plastic and/or rubber.

Figure 4B:
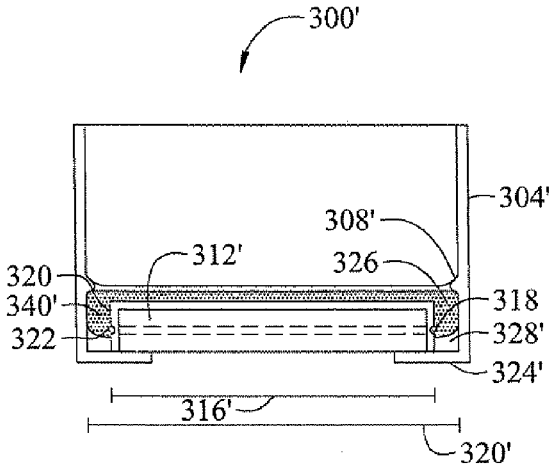
FIG. 4B is an elevational cross-sectional view of an illuminable device including a sizing ring in accordance with one implementation of the disclosure.

Another configuration of an illuminable holding device is indicated generally in FIG. 4B by reference number 300'. The device is shown in cross section and includes a sidewall 304' having a retaining ring 308'. A light disk 312', which has a diameter 316' smaller than a diameter 320' of the device 300', is supported on a ledge 324'. Thus a space 328' is defined between the disk 312' and sidewall 304'. The disk 312' may be water-resistant and includes a base and circuit board (not shown) and a cover 314'. The disk cover 314' has a thin (e.g., one millimeter thick) circumferential groove 318 in and around a lateral wall 320 of the cover 314'. A portion 322 of an elastic sizing ring 340' is retained in the groove 318 around the disk cover 314'. A portion 326 of the sizing ring 340' extends into the space 328' to center the disk 312' relative to the retaining ring 308'. The sizing ring 340' is made of rubber and/or other elastic material(s).

Figure 5A:
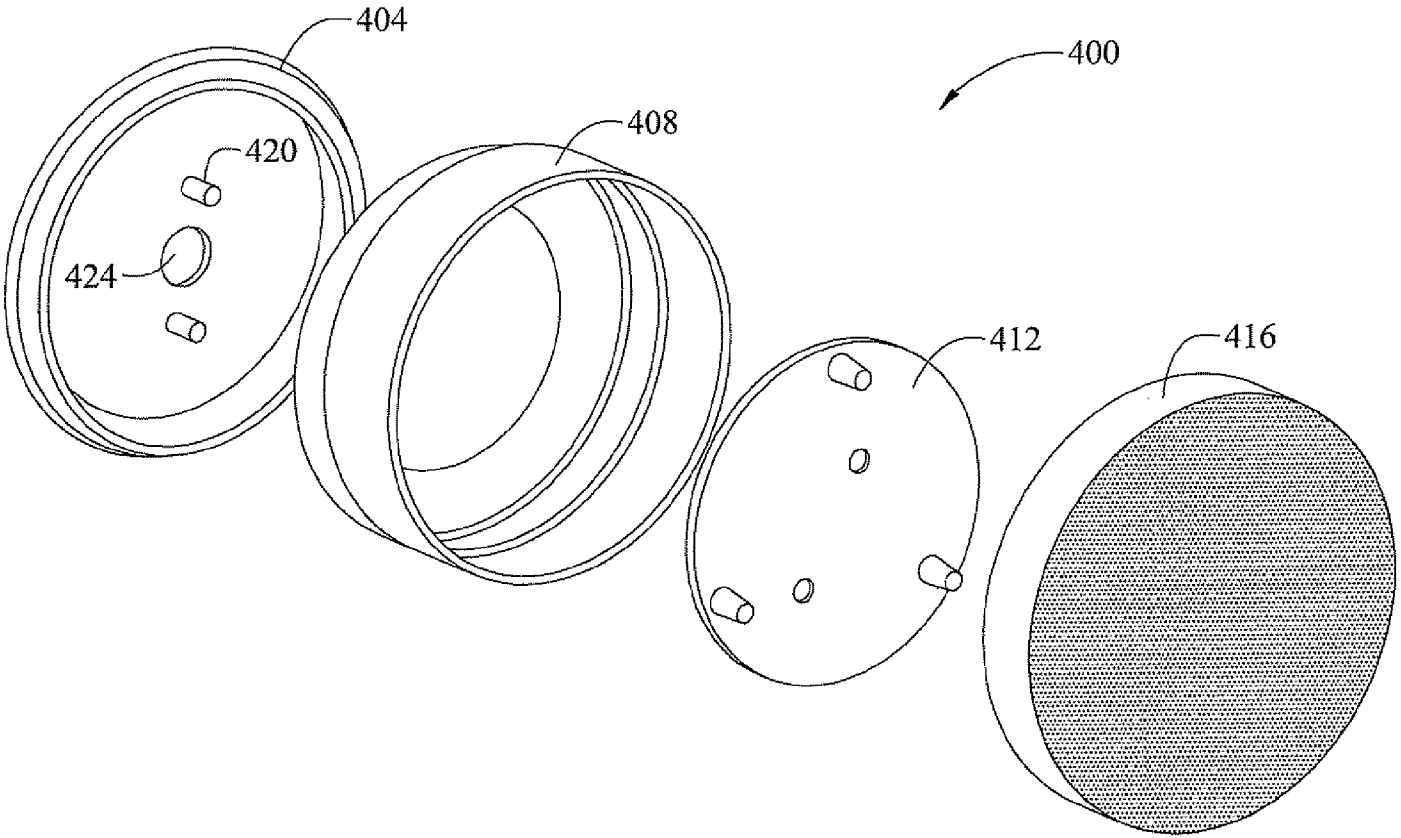
FIG. 5A is an exploded perspective view of an illuminable device in accordance with one implementation of the disclosure.
Figure 5B:
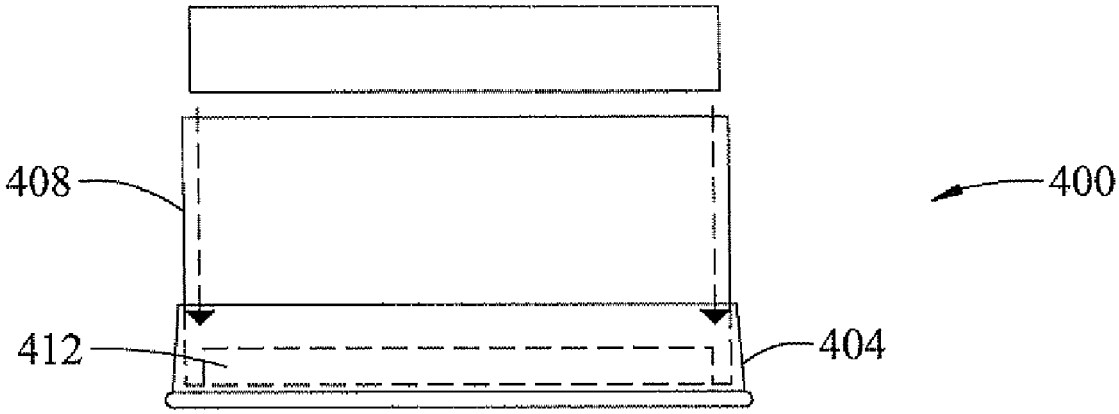
FIG. 5B is an exploded side view of the illuminable device shown in FIG. 5A.

Another configuration of an illuminable holding device is indicated generally in FIGS. 5A and 5B by reference number 400. An exploded view of the device 400 is shown in FIG. 5A. The device 400 includes a base 404, a sidewall 408, a circuit board 412, and a disk cover 416. The base 404 includes mounts 420 for the circuit board 412 and a central hole 424 for mounting an on/off switch (not shown). The device 400 is assembled as shown in FIG. 6B. The circuit board 412 is mounted on the base 404. The sidewall 408 is inserted into the base 404 around the circuit board 412. The light disk cover 416 is inserted into the sidewall 408 as shown by the dashed arrows, i.e., onto the base 404 over the circuit board 412 and between the circuit board 412 and the sidewall 408.

Figure 6:
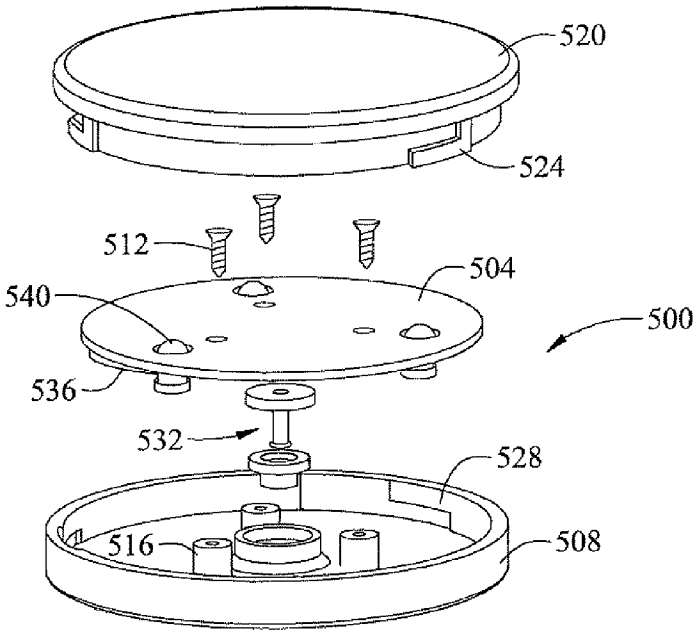
FIG. 6 is an exploded perspective view of an illuminable device in accordance with one implementation of the disclosure.

Various light disk configurations are contemplated. For example, as shown in FIG. 6, a light disk configuration 500 includes a circuit board 504 that is screwed into a base 508 using screws 512 and screw mounts 516. A cover 520 of the disk 500 has external lateral threading 524 that matches internal threading 528 in the base 508. Thus the cover 520 may be twisted into the base 508 to seal the disk 500. Also shown in FIG. 6 are an on/off switch configuration, referred to generally by reference number 532. One or more batteries 536 are included beneath the circuit board 504. A plurality of LEDs 540 are configured to project light above the circuit board 504.

Figure 7A:
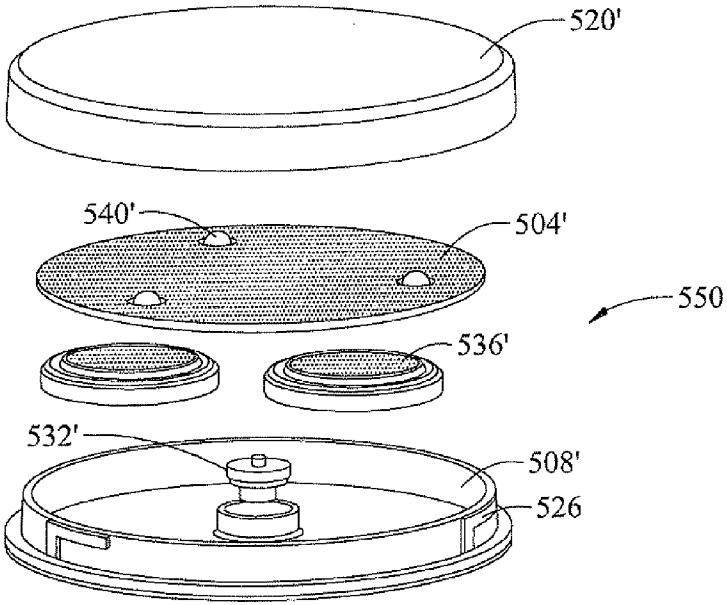
FIG. 7A is an exploded perspective view of an illuminable device in accordance with one implementation of the disclosure.
Figure 7B:
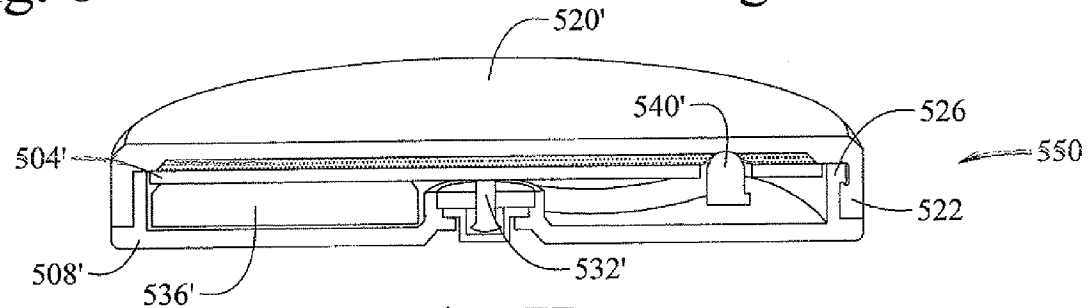
FIG. 7B is a cross-sectional perspective view of the illuminable device shown in FIG. 7A.

As shown in FIGS. 7A and 7B, a light disk configuration 550 includes a circuit board 504' that is press-fit into a base 508'. A cover 520' of the disk 550 has internal lateral threading 522 that matches external threading 526 on the base 508'. Thus the cover 520' may be twisted onto the base 508' to seal the disk 550. Also shown in FIGS. 8A and 8B are an on/off switch configuration 532', a pair of batteries 536' beneath the circuit board 504', and a plurality of LEDs 540' configured to project light above the circuit board 504'.

Figure 8A:
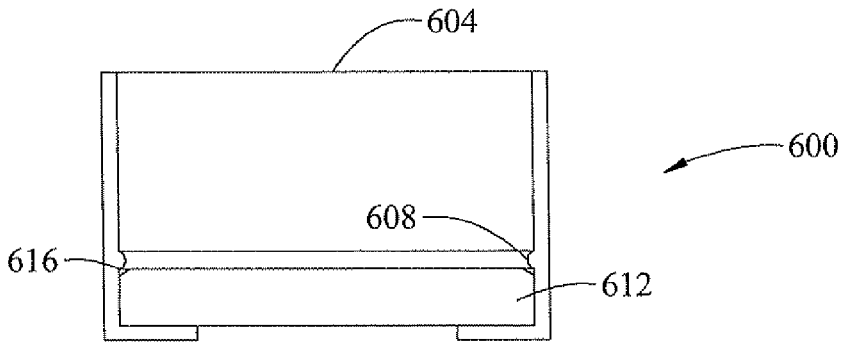
FIG. 8A is an elevational cross-sectional view of an illuminable device in accordance with one implementation of the disclosure.

Another configuration of an accessory device is indicated generally in FIG. 8A by reference number 600. A sidewall 604 includes a retaining device 608. A light disk 612, an outline of which is shown in FIG. 8A, has a mitered circumferential edge 616. To assemble the accessory device 600, the disk 612 is pressed downward into the sidewall 604 and past the retaining device 608, which keeps the disk from moving upward in the sidewall.

Figure 8B:
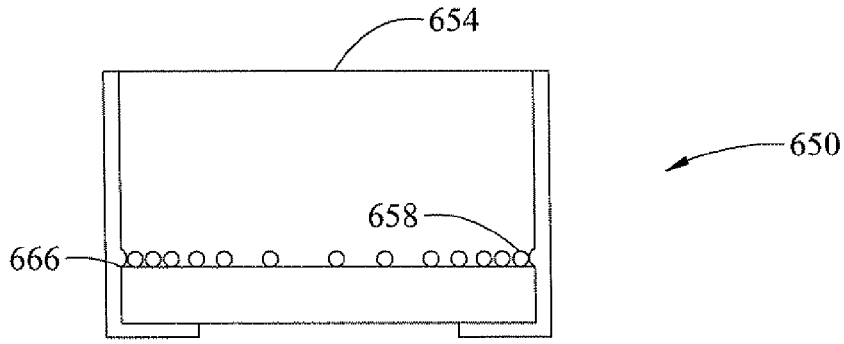
FIG. 8B is an elevational cross-sectional view of an illuminable device in accordance with one implementation of the disclosure.

Another configuration of an accessory device is indicated generally in FIG. 8B by reference number 650. A sidewall 654 includes a plurality of protruding beads 658 that serve as a retaining device. A light disk 662, an outline of which is shown in FIG. 8B, has a square circumferential edge 666. To assemble the accessory device 650, the disk 662 is pressed downward into the sidewall 654 and past the retaining device 658, which keeps the disk from moving upward in the sidewall.

Figure 8C:
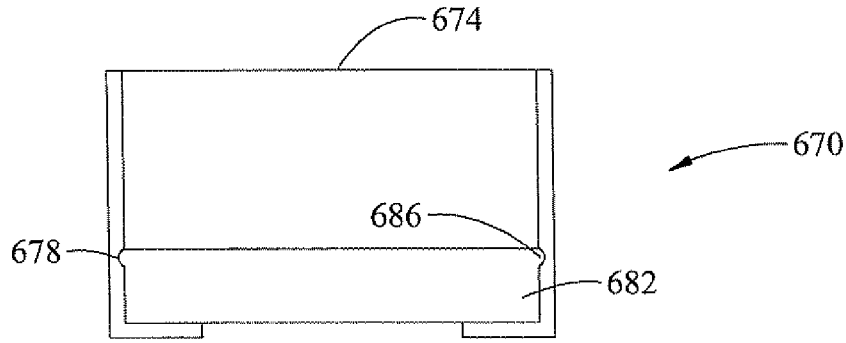
FIG. 8C is an elevational cross-sectional view of an illuminable device in accordance with one implementation of the disclosure.

Another configuration of an accessory device is indicated generally in FIG. 8C by reference number 670. A sidewall 674 includes a circumferential groove 678 that serves as a retaining device. A light disk 682, an outline of which is shown in FIG. 8C, has a circumferential rib 686. To assemble the accessory device 670, the disk 682 is pressed downward into the sidewall 674 until the rib 686 is inserted into the groove 678, which keeps the disk from moving upward in the sidewall.

Figure 9A:
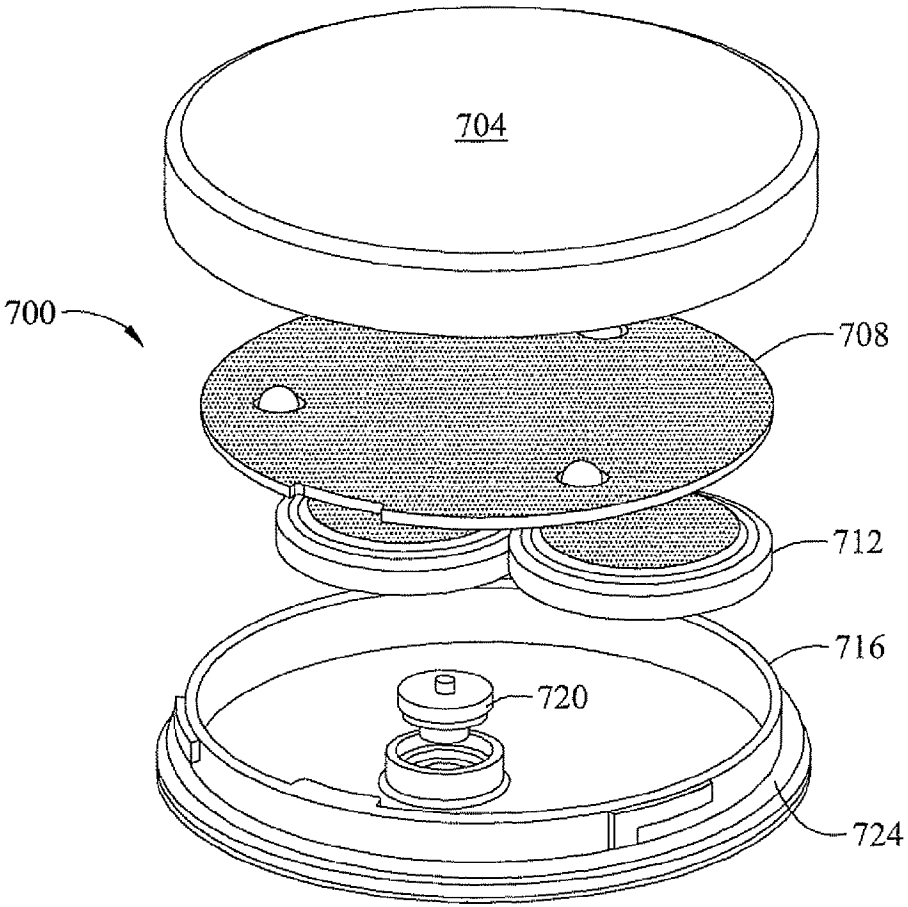
FIG. 9A is a perspective view of a light disk in accordance with one implementation of the disclosure.

Another configuration of a light disk is indicated generally in FIG. 9A by reference number 700. The disk 700 includes a cover 704, a circuit board 708, batteries 712, a base 716, an on/off device 720, and an O-ring 724 positioned around the base 716. The O-ring 724 serves to seal the disk, e.g., from liquids when the cover 704 is fastened to the base 716. Although the O-ring 724 has a square profile, O-rings could be round, rectangular, flat, etc. in profile.

Figure 9B:
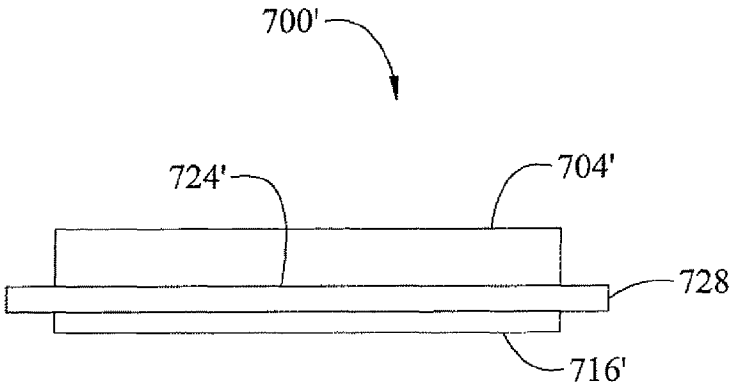
FIG. 9B is a side view of a light disk in accordance with one implementation of the disclosure.

Another light disk configuration is indicated generally in FIG. 9B by reference number 700'. The disk 700' includes an O-ring 724' having a portion 728 that extends past a base 716' of the disk. The O-ring portion 728 may serve as a sizing ring, e.g., to center the disk 700' in a sidewall (not shown) having a diameter larger than that of the disk 700'. The sizing portion 728 could have various shapes and sizes, for example, as previously discussed with reference to FIGS. 2A-4B.

Figure 10A:
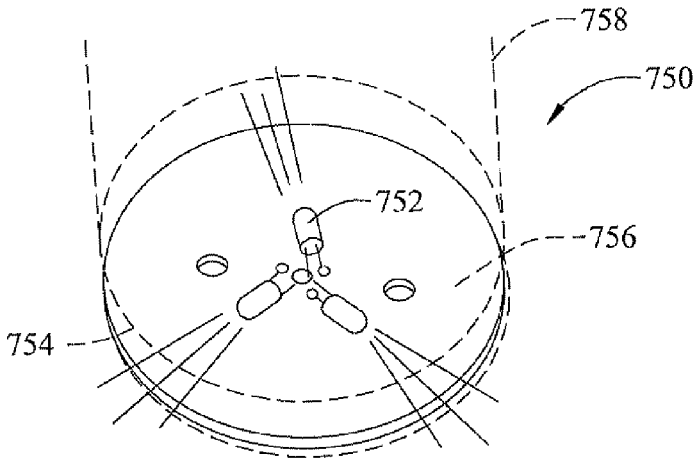
FIG. 10A is a perspective view of a light disk circuit board in accordance with one implementation of the disclosure.

Various lighting effects can be achieved by orienting LEDs in various directions relative to a circuit board, disk cover and/or sidewall of an illuminable device. One configuration of a light disk circuit board is indicated generally in FIG. 10A by reference number 750. Three light-emitting diodes (LEDs) 752 are oriented sideways, e.g., to project light through the side 754 of a disk cover 756 (shown in phantom) and toward a sidewall 758 (also shown in phantom) surrounding the disk cover 756. Where, for example, the sidewall 758 is imprinted and/or impressed with a logo, design, and/or textual message, light from the LEDs 752 can penetrate the disk cover 756 and sidewall 758 to highlight the visual features in or on the sidewall 758. In such manner, an illuminable device can serve as an illuminated advertising medium even when holding cans and/or other vessels that are completely opaque. In some configurations, the disk side 754 and/or cover 756 can be imprinted and/or impressed with a logo, design, and/or textual message. When illuminated by the LEDs 752, the disk side 754 and/or cover 756 may be seen, e.g., through the sidewall 758, which can be at least partially transparent and/or translucent. Various patterns, transparencies, translucent areas, and/or colors can be provided in or on the disk cover 756 and side 754 and/or sidewall 758 to obtain a variety of lighting and color effects.

Figure 10B:
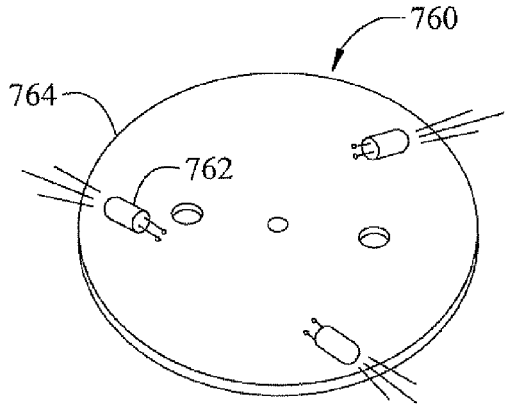
FIG. 10B is a perspective view of a light disk circuit board in accordance with one implementation of the disclosure.

The LEDs 752 are substantially centered on the circuit board 750. Other or additional LED positionings are contemplated. For example, another configuration of a light disk circuit board is indicated generally in FIG. 10B by reference number 760. Three LEDs 762 are positioned near an edge 764 of the circuit board 760 and are oriented sideways.

Figure 10C:
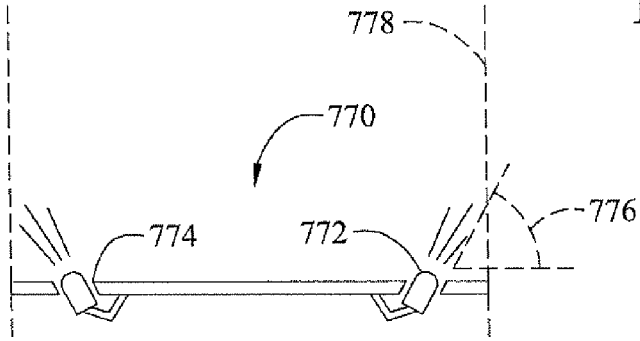
FIG. 10C is a side cross-sectional view of a light disk circuit board in accordance with one implementation of the disclosure.

Light sources could be positioned and angled to project light in many different ways relative to a circuit board and are not necessarily mounted on top of a circuit board. For example, another configuration of a light disk circuit board is indicated generally in FIG. 10C by reference number 770. A plurality of LEDs 772 are mounted beneath the circuit board 770. The LEDs 772 extend upward through circuit board openings 774 and emit light at an angle 776 substantially toward an illuminable device sidewall 778 (shown in phantom). Light angled upward in such a manner can dramatically illuminate the sidewall, which can be imprinted and/or impressed, e.g., with promotional material and/or decorative designs.

In various configurations of the foregoing accessory device, the light disk is liquid-resistant yet accessible, e.g., so that batteries can be changed or removed. The disk also is easily inserted into and removed from the sidewall. Accordingly, the disk may be reused, e.g., in a different accessory device. The disk and/or sidewall may have various areas of translucency, transparency, and/or opacity. Translucent, transparent, and/or opaque areas could be provided in various colors for various lighting effects. Further, reflective materials, e.g., reflective film, may be included in and/or on various areas of the disk and/or sidewall. LEDs may be provided in various numbers, colors and/or color combinations, including red, blue, green, and/or ultraviolet (UV). UV LEDs could be provided to illuminate luminescent material on the accessory device (or in some instances, on the label of a vessel held by the device) to provide a black-light effect. A light disk could have many different modes of operation, including (without limitation) steady-on, flash-and-blink modes and/or fading and/or slow-fade modes.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An illuminable accessory device for use with a vessel, the device comprising:

a pliable, generally cylindrical sidewall configured to slidingly receive and hold a bottom portion of a vessel and from which the received vessel bottom portion is slidingly removable; and an electrically powered light source surrounded by the sidewall and configured to lie beneath the received vessel bottom portion, the light source enclosed in a generally cylindrical light disk through at least a portion of which light from the light source is transmissible, the light disk in a position relative to the sidewall such that the light disk is configured to support the received vessel, the light disk having a circumferential wall configured for cooperation with the sidewall to maintain the position of the light disk relative to the sidewall.

2. The accessory device of claim 1, the light source further configured to transmit light through the at least a portion of the disk toward the vessel.

3. The accessory device of claim 1, the sidewall comprising a thickness of 0.03 inches.

4. The accessory device of claim 1, the light source comprising one or more light-emitting diodes (LEDs) oriented to emit light substantially toward the sidewall.

5. The accessory device of claim 1, further comprising a sizing ring between the light disk and the sidewall.

6. The accessory device of claim 5, the sidewall further comprising a retaining device, the sizing ring configured with the retaining device to retain the disk in the sidewall.

7. The accessory device of claim 1, the sidewall comprising at least a portion that is translucent.

8. An illuminable accessory device for use with a vessel, the device comprising:

a pliable, generally cylindrical sidewall having a bottom end at which the sidewall terminates;

a bottom ledge extending radially inwardly generally from the bottom end of the sidewall; and a generally cylindrical light disk supported on the ledge inside the sidewall, the disk enclosing an electrically powered light source capable of emitting light through at least a portion of the disk;

the sidewall configured to slidingly receive and adhere to a bottom portion of a vessel;

the disk configured to lie beneath the received vessel bottom portion;

the sidewall further configured to allow the received vessel bottom portion to be slidingly removed from the device.

9. The device of claim 8, the sidewall comprising a substantially smooth inner surface relative to which the vessel bottom portion is slidingly receivable and slidingly removable.

10. The device of claim 8, the sidewall configured to receive the bottom portion of a manually crushable vessel without damage to the vessel.

11. The device of claim 8, further comprising a sizing ring between the light disk and the sidewall.

12. The device of claim 8, the light source comprising one or more light-emitting diodes (LEDs) oriented to emit light substantially toward the sidewall.

13. The device of claim 12, wherein the sidewall is at least partly translucent.

14. The device of claim 8, the disk comprising a liquid-resistant exterior.

15. An illuminable accessory device for use with a vessel, the device comprising:

a pliable, generally cylindrical sidewall configured to slidingly receive and hold a bottom portion of a vessel and from which the received vessel bottom portion is slidingly removable, the sidewall having a top end at which the sidewall terminates; and an electrically powered light source surrounded by the sidewall and configured to lie beneath the received vessel bottom portion, the light source enclosed in a generally cylindrical, liquid-resistant and at least partially translucent light disk configured to support the received vessel, the disk removable from the accessory device through the top end of the sidewall.

16. The accessory device of claim 15, the light source comprising one or more light-emitting diodes (LEDs).

17. The accessory device of claim 15, the light disk comprising a base, a cover, and at least one battery;

the cover replaceably removable to access the at least one battery.

18. The accessory device of claim 15, further comprising a sizing ring between the disk and the sidewall.

19. The accessory device of claim 15, the sidewall comprising a retaining device configured to retain the disk in the sidewall.

20. The accessory device of claim 19, the retaining device comprising at least one of the following: a circumferential ring protruding radially inward from the sidewall, a circumferential groove in the sidewall, a plurality of beads protruding radially inward from the sidewall, and a plurality of dimples in the sidewall.

21. The accessory device of claim 15, further comprising an O-ring between a cover of the light disk and a base of the light disk, the O-ring having a portion extending radially outwardly from the base and configured to center the disk in the sidewall.

* * * * *